US006053382A

United States Patent [19]

Wyant

[11] Patent Number: 6,053,382

[45] Date of Patent: Apr. 25, 2000

[54] ZIPPER EXPANSION GUSSET FOR A BACKPACK

[75] Inventor: Jon Richard Wyant, Centerville, Ohio

[73] Assignee: The Mead Corporation, Dayton, Ohio

[21] Appl. No.: 09/325,305

[22] Filed: Jun. 3, 1999

[51] Int. Cl.[7] ..... A45F 3/04

[52] U.S. Cl. ..... 224/153; 224/581; 224/645; 190/103

[58] Field of Search ..... 224/153, 581, 224/582, 583, 627, 645, 654, 657; 190/103, 104, 105

[56] References Cited

U.S. PATENT DOCUMENTS

| | | | |
|---|---|---|---|
| 1,273,875 | 7/1918 | Kosta | 190/103 X |
| 2,173,120 | 8/1939 | Lifton . | |
| 2,252,783 | 8/1941 | Potts et al. . | |
| 2,502,275 | 3/1950 | Perlin . | |
| 2,755,837 | 7/1956 | Kosek . | |
| 2,778,397 | 1/1957 | Carrasco . | |
| 3,233,803 | 2/1966 | Gray | 224/153 X |
| 3,280,871 | 10/1966 | Taylor . | |
| 3,587,795 | 6/1971 | Berry et al. . | |
| 4,085,873 | 4/1978 | Schweitzer . | |
| 4,303,602 | 12/1981 | Lichter et al. | 264/45.4 |
| 4,610,923 | 9/1986 | Schrock . | |
| 4,629,349 | 12/1986 | Pitts . | |
| 4,629,651 | 12/1986 | Davis . | |
| 4,773,515 | 9/1988 | Kotkins, Jr. | 190/103 |
| 4,775,257 | 10/1988 | Rigg . | |
| 4,887,751 | 12/1989 | Lehman | 190/103 X |
| 4,961,596 | 10/1990 | Moor . | |
| 5,005,744 | 4/1991 | Gleason . | |
| 5,060,795 | 10/1991 | Bomes et al. | 190/103 X |
| 5,080,206 | 1/1992 | Tawil . | |
| 5,153,939 | 10/1992 | Howe et al. | 2/69 |
| 5,161,731 | 11/1992 | Rivlin et al. . | |
| 5,180,057 | 1/1993 | Franklin | 190/103 X |
| 5,217,119 | 6/1993 | Hollingsworth . | |
| 5,219,437 | 6/1993 | Moor . | |
| 5,228,547 | 7/1993 | Yoo . | |
| 5,236,226 | 8/1993 | Sheffield . | |
| 5,497,919 | 3/1996 | Lichter et al. | 264/45.4 |
| 5,611,573 | 3/1997 | Lobe et al. . | |
| 5,711,750 | 1/1998 | Christensen et al. | 493/210 |
| 5,743,447 | 4/1998 | McDermott . | |
| 5,749,666 | 5/1998 | Yu . | |
| 5,797,529 | 8/1998 | Lavine . | |
| 5,799,851 | 9/1998 | Wulf et al. | 224/582 X |

FOREIGN PATENT DOCUMENTS

| | | | |
|---|---|---|---|
| 1427400 | 6/1941 | France | 190/103 |
| 1474951 | of 1966 | France . | |
| 2626753 | 5/1988 | France . | |
| 2660170 | 4/1991 | France . | |
| 63576 | 6/1941 | Norway | 224/209 |

*Primary Examiner*—Gregory M. Vidovich
*Attorney, Agent, or Firm*—Thompson Hine & Flory LLP

[57] ABSTRACT

In accordance with the present invention, a school-use backpack is provided which is similar in styling to conventional school-use backpacks, is durable, and which can be expanded to increase the interior storage volume of the backpack when additional storage space is required. In particular, the backpack of the present invention includes front, back, and side panels which define a zippered main storage compartment, two shoulder straps, and a zippered gusset which is sewn into the side panel of the backpack.

11 Claims, 6 Drawing Sheets

ZIPPER EXPANSION GUSSET FOR A BACKPACK

BACKGROUND OF THE INVENTION

The invention relates to a backpack for holding and transporting papers, books, school supplies, etc., which includes a gusset for expanding the interior volume of the backpack. More particularly, the backpack of the present invention includes an expandable gusset which is sewn into the lining of the backpack and which has a zipper attached around a periphery thereof. The zipper is provided so that the backpack may be modified from a "compact," gusset folded configuration to an expanded, gusset unfolded configuration simply and easily. In particular, the zipper for the gusset of the present invention is generally kept in the "compact," gusset folded configuration. However, when additional storage volume is required, the zipper may be unzipped to allow the gusset to unfold, thereby expanding the interior volume of the backpack. Preferably, a support flap is provided for the base of the backpack which folds down over the floor panel to provide additional support for the backpack base. Additionally, in a preferred embodiment, the zippered gusset of the present invention is positioned on the back portion of the backpack and extends approximately three fourths of the height of the backpack in order to prevent an undue amount of stress from being placed on the seams of the gusset or the gusset itself.

In the past there have been backpacks and knapsacks of many sizes and shapes which are designed for use by school-aged children for carrying textbooks, notebooks, pens, pencils and other school supplies to and from classes, as well as back and forth between home and school. While these backpacks have varied in shape and design, they generally have been constructed in a similar, rather conventional manner. For example, a standard backpack has generally included two shoulder straps, a main compartment which is enclosed by a zipper and at least one additional auxiliary compartment or pouch, for storing smaller items. An example of a backpack that is similar to this "standard" backpack is disclosed in U.S. Pat. No. 4,085,873 to Schweitzer. Notwithstanding the extra pouch provided on the Schweitzer backpack to allow the backpack to be collapsed inward to form a streamlined pouch when the backpack is not in use, the rest of the features (two shoulder straps, a zippered central compartment, etc.) of the Schweitzer patent are fairly standard to typical school use backpacks and are known in the industry.

While backpacks similar to the one disclosed in Schweitzer have generally adequately fulfilled students' transportation and storage requirements to date, there recently has been a need to have backpacks which have larger storage capacities than prior art backpacks. In particular, with larger textbooks, a greater emphasis on homework assignments, and in some instances, the complete elimination of school lockers, the need for larger capacity backpacks has become attenuated. Accordingly, there have been several attempts to provide improved backpacks which address this need. For example, U.S. Pat. No. 5,743,447 to McDermott discloses a portable variable capacity backpack having detachable shoulder straps, wheels, a handle, at least one detachable compartment, and an expandable compartment for storing books and school supplies. U.S. Pat. No. 5,797,529 to Lavine discloses a convertible multi-use bag which may be converted from a backpack, to a tote bag, to a fanny pack. The bag of the Lavine patent is characterized in that it may be simply and easily converted between the above-identified configurations in a way which does not require the "stuffing" of a larger pocket into a smaller one.

Additionally, the use of gussets to increase the volume of storage bags other than backpacks is known. For example, U.S. Pat. No. 2,173,120 discloses a portable storage bag which uses an expandable gusset having front and rear flexible panels, preferably made of leather, that are spaced apart by a split flexible gusset having a zipper mechanism for closing the gusset. A strengthening member is employed to help the flexible components and gusset to retain their desired shape. A soft sided leather briefcase made by W.K. Leathers which utilizes a gusset which may be zippered shut when not in use is also known. The gusset of the W.K. Leathers briefcase is used to expand the storage volume of an exterior pocket of the briefcase when the zipper is opened. However, the gusset of the W.K. Leathers briefcase extends around the entire perimeter of the storage pocket, meaning that the weight of the contents of the briefcase must be borne by the seams of the gusset.

While many of these prior art backpacks and storage bags have advantages, there continues to be a need to design a backpack which has the attributes and styling of a conventional school use backpack but which has the capability of expanding when a larger storage volume is required. Additionally, while it is important for current school-use backpacks to fulfill the requirements of greater storage capacity and ease of use, it is almost equally important for these backpacks to have design attributes which are attractive and look "cool" to the consumers of the backpack. Additionally, the durability of the backpack is a significant concern given the weight of the textbooks that are carried in the backpack and the abuse that is generally given to the backpack by its user.

SUMMARY OF THE INVENTION

In accordance with the present invention, a school-use backpack is provided which is similar in styling to conventional school-use backpacks, is durable, and which can be expanded to increase the interior storage volume of the backpack when additional storage space is required. In particular, the backpack of the present invention includes front, back, and side panels which define a zippered main storage compartment, two shoulder straps, and a zippered gusset which is sewn into the side panel of the backpack. Preferably the backpack is composed mainly of a high strength, lightweight nylon fabric, although any suitable materials may be used. Also in a preferred embodiment, a zippered auxiliary pocket is provided on the front panel of the backpack.

More specifically, the construction of the backpack of the present invention is as follows. The back panel (which has a cushioned strengthening member incorporated therein) and the front panel are generally rectangular in shape and are sewn together by the side panel. The side panel extends around the entire perimeter of the backpack and preferably has a strengthening panel which is sewn to the bottom thereof to add additional support for the base of the backpack. Additionally, a support flap, preferably made of a rigid plastic or fiber board, is provided on the interior of the main storage compartment. The support flap is hinged to the bottom back seam of the back panel and the side panel such that it may be folded over the side panel to provide additional support for the base of the backpack when necessary. The auxiliary pocket is preferably sewn to the front panel of the backpack and includes a zipper to provide access to the contents thereof.

The gusset for expanding the storage volume of the main compartment is sewn in an aperture in the side panel near the back panel of the backpack. A zipper is provided which extends around the length of the gusset. The zipper is positioned so that when the zipper is closed the gusset is prevented from expanding. However, when the zipper is opened, the gusset is allowed to expand thereby increasing the volume that is available in the main storage compartment of the backpack. This increase in the storage volume of the backpack is created by increasing the "footprint" (the area of the base) of the backpack and the area covered by the side panel of the backpack. In a preferred embodiment, the gusset extends upwards approximately three fourths of the height of the backpack and ends below the attachment point for the backpack's two shoulder straps. This configuration is important because it reduces the amount of load from the backpack that is placed directly on the seams of the gusset and thus increases the durability of the backpack.

DETAILED DESCRIPTION

Figure 1:
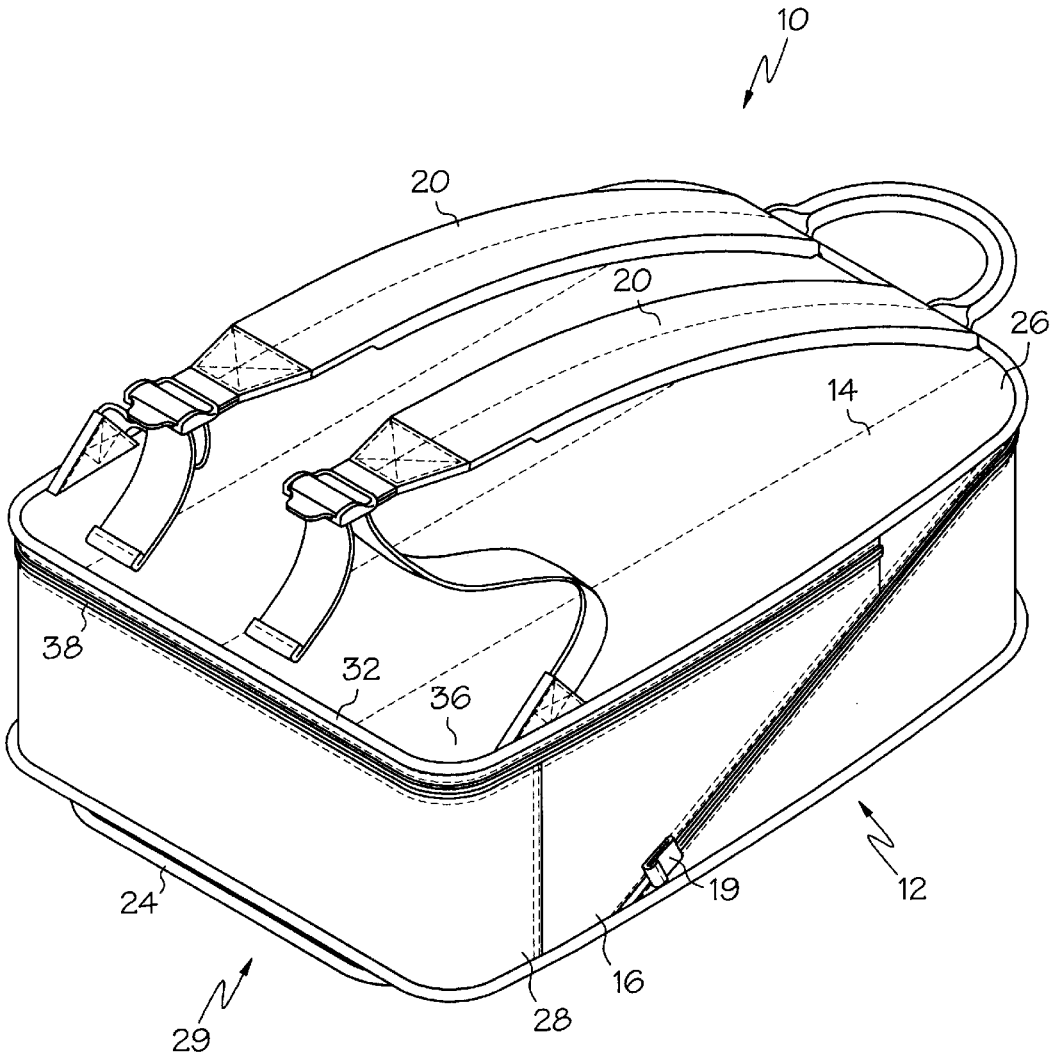
FIG. 1 is a bottom side perspective view of a backpack with a zipper expansion gusset in accordance with the present invention.

In accordance with the present invention, a school-use backpack 10 is provided which is similar in styling to conventional school-use backpacks, is durable, and which can be expanded to increase the interior storage volume of the backpack 10 when additional storage space is required. In particular, the backpack 10 of the present invention includes front 12, back 14, and side panels 16 which define a main storage compartment 18 having a zipper closure 19, two shoulder straps 20, and a zippered gusset 22 which is sewn into the side panel 16 of the backpack 10. Preferably the backpack 10 is composed mainly of a high strength, lightweight nylon fabric, although any suitable materials may be used. Also in a preferred embodiment, an auxiliary pocket 24 having a zipper closure 34 is provided on the front panel 12 of the backpack 10.

More specifically, the construction of the backpack 10 of the present invention is as follows. The back panel 14 (which has a cushioned strengthening member (not shown) incorporated therein) and the front panel 12 are generally rectangular in shape and are sewn together by the side panel 16 to form a main storage compartment 18. Access to the main storage compartment 18 is preferably achieved through a zipper closure 19, although other forms of releasable closures, such as hook and loop material, may be used. The side panel 16 extends around the entire perimeter of the backpack 10 and preferably has a strengthening panel 28 which is sewn to the bottom thereof to add additional support for the base 29 of the backpack 10. Additionally, a support flap 30, preferably made of a rigid plastic or fiber board, is provided on the interior of the main storage compartment 18. The support flap 30 is hinged to the bottom back seam 32 of the back panel 14 and the side panel 16 such that it may be folded over the side panel 16 to provide additional support for the base 29 of the backpack 10 when necessary. The auxiliary pocket 24 is preferably sewn to the front panel 12 of the backpack 10 and includes a zipper 34 to provide access to the contents thereof. The shoulder straps 20 of the backpack 10 are attached to the top 26 and bottom 36 of the back panel 14. While the exact attachment points for the shoulder straps 20 may vary, it is preferred that they be close to the top 26 and bottom 36 of the back panel 14, respectively, in order to evenly and effectively distribute the weight borne by the backpack 10.

In a preferred embodiment, the gusset 22 for expanding the storage volume of the main compartment 18 is sewn in an aperture in the lower part of the side panel 16 near the back panel 14 and is rectangular shaped on the base and triangularly shaped. A zipper 38 is provided which extends around the length of the gusset 22. The zipper 38 is positioned so that when the zipper 38 is closed the gusset 22 is prevented from expanding. However, when the zipper 38 is opened, the gusset 22 is allowed to expand thereby increasing the volume that is available in the main storage compartment 18 of the backpack 10. The increase in the storage volume of the backpack 10 is created by increasing the "footprint" (the area of the base 29) of the backpack 10 and the area of the side of the backpack 10, which is the area of the side panel 16 plus the area of the gusset 22. In a preferred embodiment, the gusset 22 extends upwards on the side panel 16 approximately three fourths of the height of the backpack 10 and ends below the attachment point for the backpack's two shoulder straps 20. In another embodiment, the gusset extends not more than ninety percent of the height of the sides of said side panel. In yet another embodiment, the gusset extends approximately seventy percent of the height of the sides of the panel. This configuration is important because it reduces the amount of load from the backpack 10 that is placed directly on the seams of the gusset 22 which are not as sturdy as the seams between the back panel 14 and the side panel 16, and thus increases the durability of the backpack 10.

Figure 2:
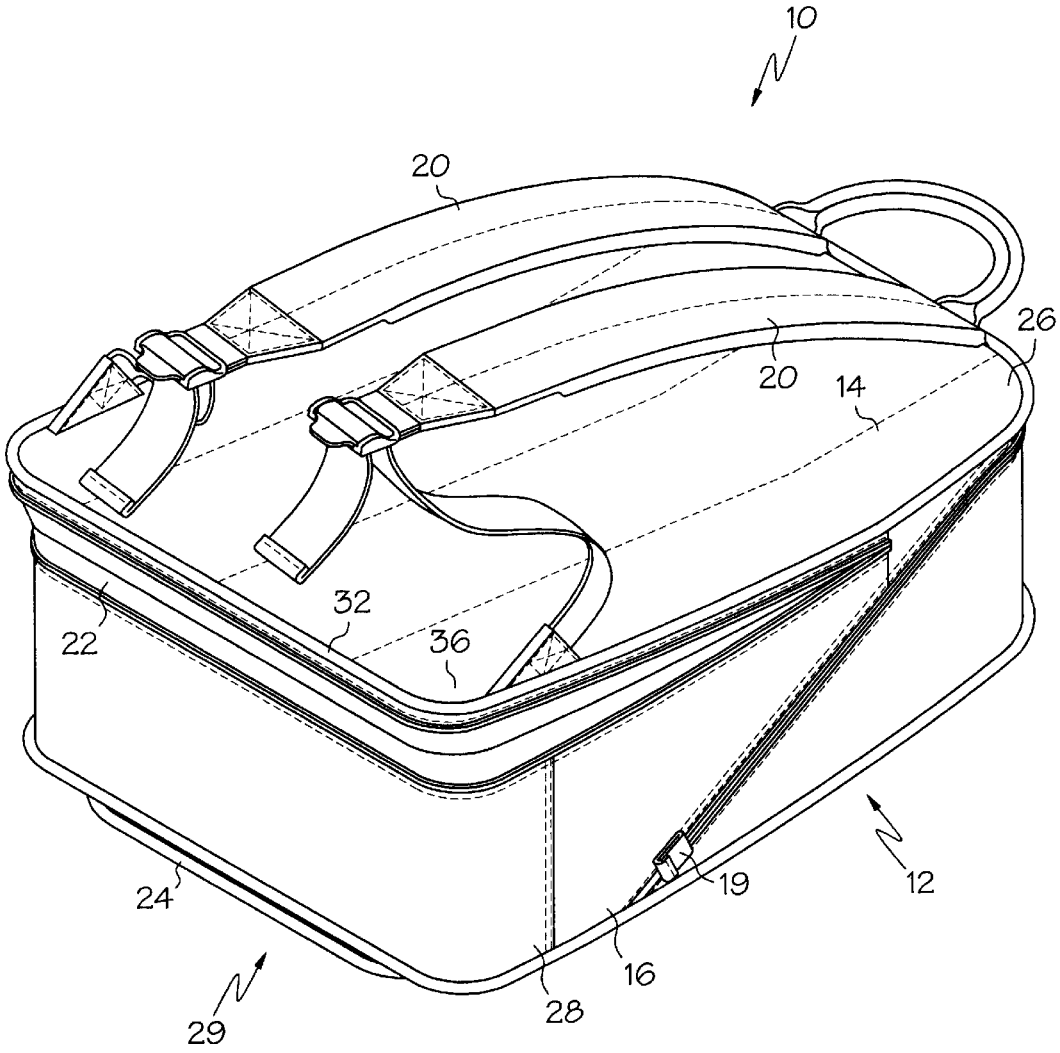
FIG. 2 is a bottom side perspective view of the backpack of FIG. 1 showing the gusset in the expanded position.
Figure 3:
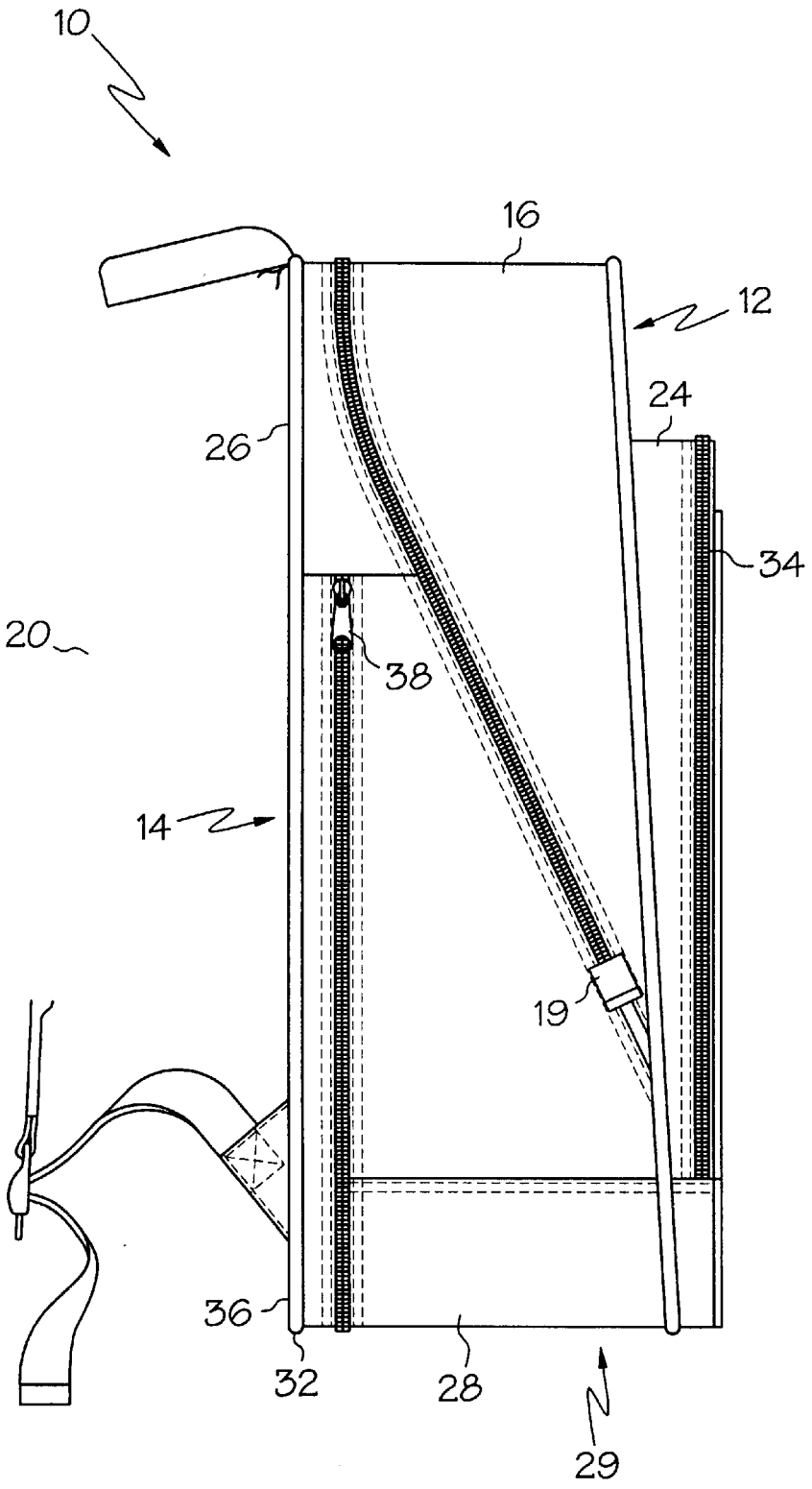
FIG. 3 is a side elevational view of the backpack of FIG. 1.
Figure 4:
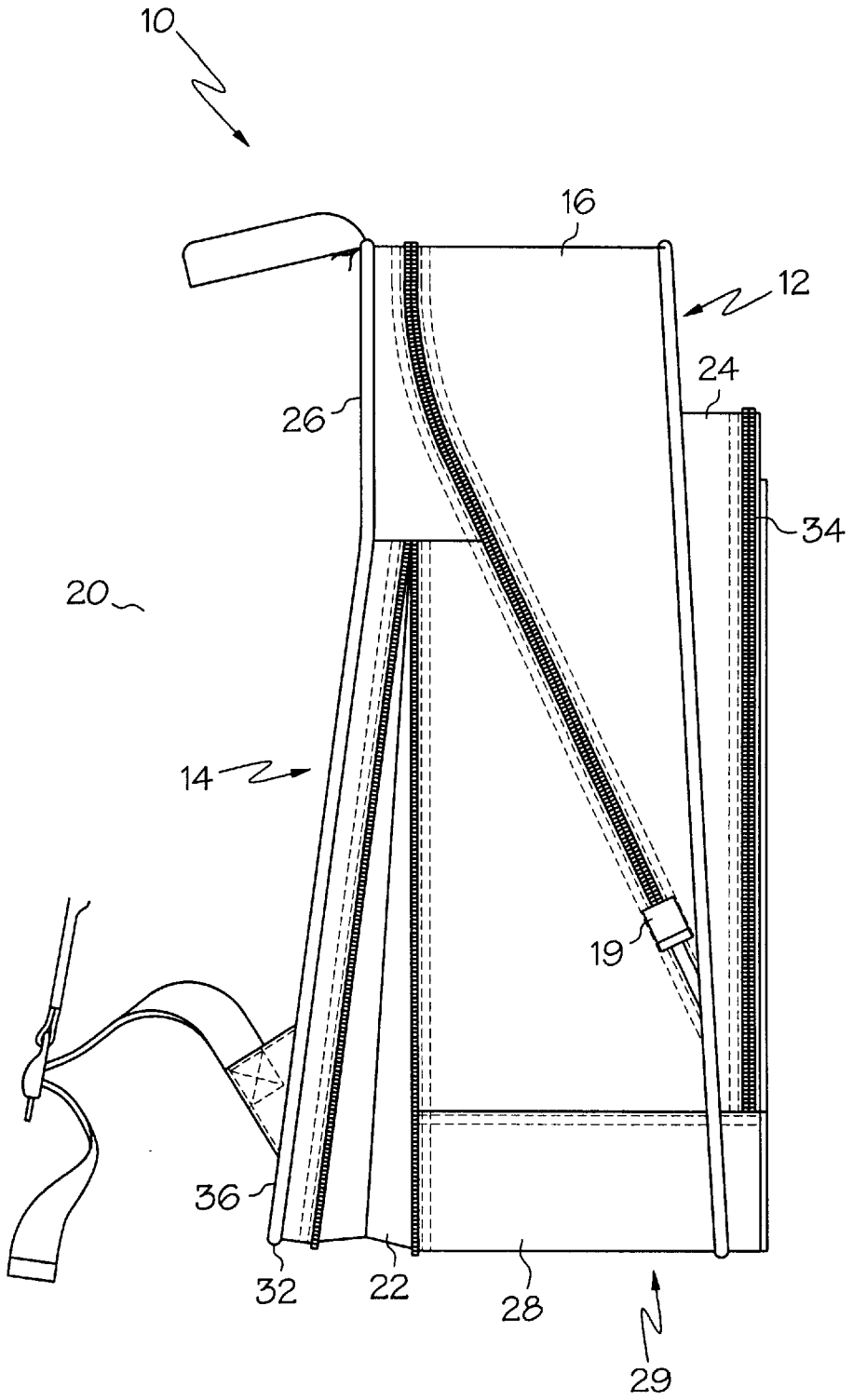
FIG. 4 is a side elevational view of the backpack of FIG. 2.
Figure 5:
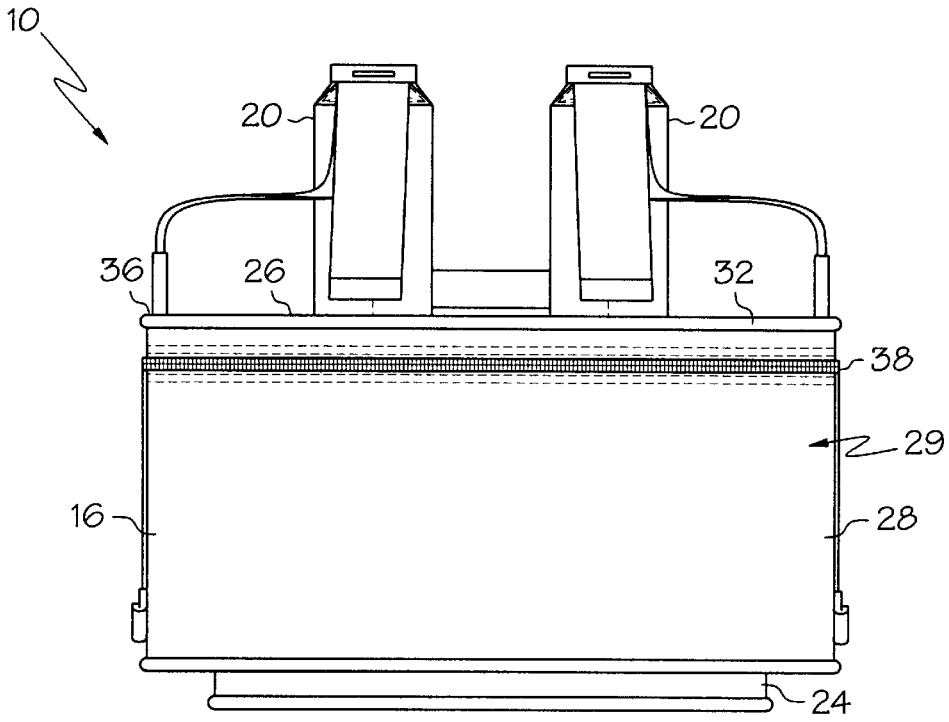
FIG. 5 is a bottom plan view of the backpack of FIG. 1.
Figure 6:
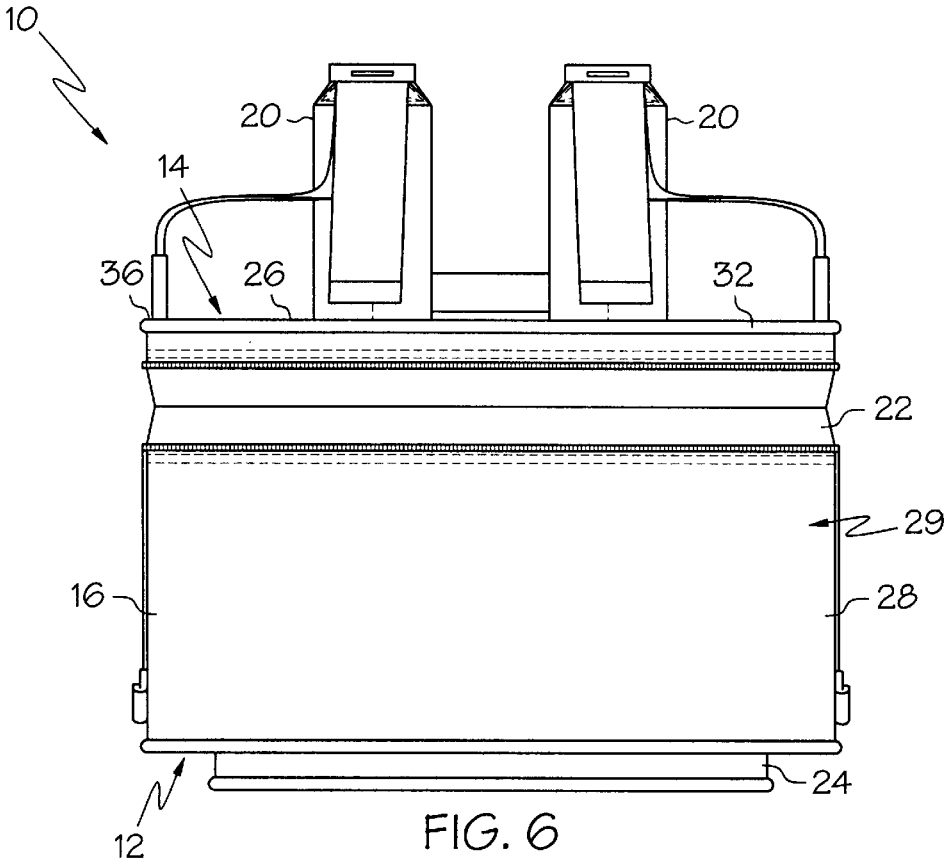
FIG. 6 is a bottom plan view of the backpack of FIG. 2.
Figure 7:
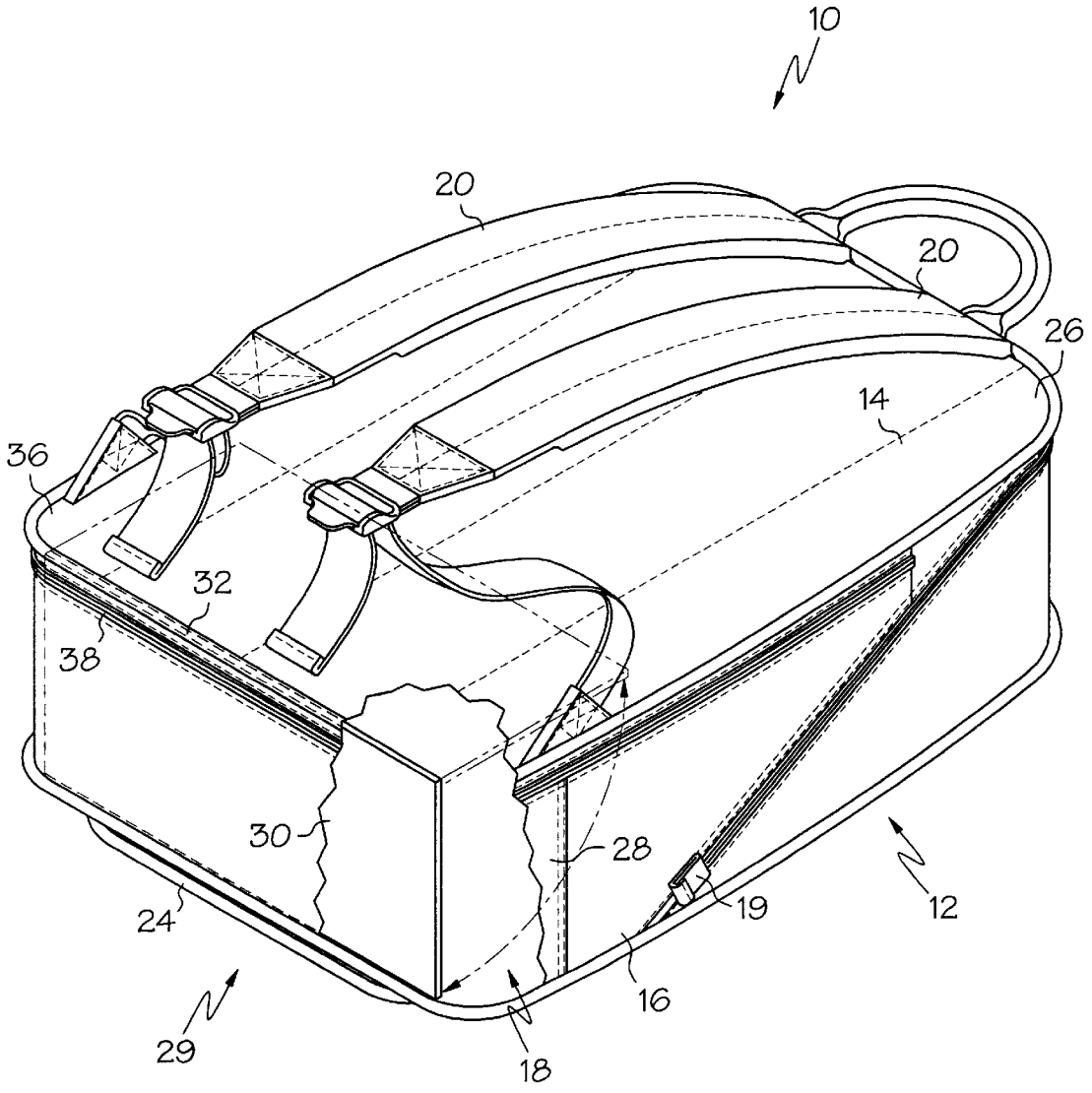
FIG. 7 is a cutaway bottom side perspective view of the backpack of FIG. 1 showing the hinging movement of the support flap.

The operation of the backpack 10 of the present invention is as follows. The backpack 10 is generally used with the zipper 38 of the gusset 22 in the closed position, thereby securing the backpack 10 in a compact, streamlined configuration (as shown in FIGS. 1, 3, 5, and 7). However, when additional storage space is required by the user, the zipper 38 is unzipped thereby allowing the gusset 22 to expand (as shown in FIGS. 2, 4, and 6). The expanded gusset 22 increases the footprint of the base 29 of the backpack 10 (as shown in FIGS. 2 and 6) and the area of a portion of the side panel 16 (as shown in FIGS. 2 and 4). This increased area creates larger usable volume in the main storage compartment 18. In a preferred embodiment, the support flap 30 (as shown in FIG. 7) may be folded down inside the main storage compartment 18 to provide additional support for the base 29 of the backpack 10.

While the form of the apparatus herein described constitutes a preferred embodiment of the invention, it is to be understood that the invention is not limited to this precise form of apparatus, and that changes may be made therein without departing from the scope of the invention.

What is claimed is:

1. A backpack comprising:

a front panel having a top, a bottom, an inner side and an outer side;

a back panel having a top, a bottom, an inner side and an outer side;

a side panel having a top, a bottom, two sides, an inner side and an outer side, said side panel being fixedly attached between said front and back panels to form a main storage compartment for said backpack and having an access aperture formed in said top and said sides of said side panel for allowing access to said compartment and an expandable gusset attached along said bottom of said side panel and a portion of each of said sides of said side panel such that said gusset extends from said bottom of said side panel to a height on each side of said side panel below said top of said side panel;

two shoulder straps fixedly attached to said backpack proximal said top outer side of said back panel to allow said backpack to be carried on the back of a wearer; and a releasable closure extending around the length of said gusset wherein when said releasable closure is closed said gusset is prevented from expansion and when said releasable closure is opened said gusset is allowed to expand to increase the storage volume of said main storage compartment.

2. The backpack of claim 1 wherein said gusset extends not more than ninety percent of the height of said sides of said side panel.

3. The backpack of claim 2 wherein said gusset extends approximately seventy percent of the height of said sides of said side panel.

4. The backpack of claim 1 wherein said gusset includes sides that are triangular in shape such that the width of said gusset decreases nearer said top of said side panel.

5. The backpack of claim 1 further comprising an auxiliary pocket fixedly attached to said outer side of said front panel.

6. The backpack of claim 1 wherein said backpack is composed primarily of nylon fabric.

7. The backpack of claim 1 wherein said access aperture is releasably closed by a zipper.

8. The backpack of claim 1 wherein said gusset is fixedly attached to said side panel by sewing.

9. The backpack of claim 1 wherein said bottom of said side panel includes an additional strengthening panel fixedly attached thereto.

10. The backpack of claim 1 further comprising a support flap hingedly attached to said bottom inner side of said back panel such that said support flap may be folded over said bottom of said side panel to provide support for said backpack main storage compartment.

11. The backpack of claim 1 wherein said side panel access opening extends at least fifty percent of the height of said side panel sides.

* * * * *